United States Patent [19]

Howard

[11] Patent Number: 4,961,612

[45] Date of Patent: Oct. 9, 1990

[54] DISHCLOTH HANGER CABINET

[76] Inventor: Barbara D. Howard, 519 Millwheel St., Capitol Heights, Md. 20743

[21] Appl. No.: 35,480

[22] Filed: Apr. 7, 1987

[51] Int. Cl.[5] ..... B65H 19/00

[52] U.S. Cl. ..... 312/37; 312/213

[58] Field of Search ..... 312/37, 213, 204, 245, 312/1, 3, 6; 211/16, 87, 105.1; 248/251, 309.2

[56] References Cited

U.S. PATENT DOCUMENTS

| | | | |
|---|---|---|---|
| 1,152,644 | 9/1915 | King | 312/213 |
| 1,706,949 | 3/1929 | Ashley et al. | 312/37 |
| 2,667,398 | 1/1954 | Claflin | 312/213 X |
| 3,819,246 | 6/1974 | List | 312/213 |
| 4,261,122 | 4/1981 | LeVine | 312/204 X |
| 4,475,654 | 10/1984 | Fruchter | 220/345 X |

*Primary Examiner*—Joseph Falk

*Attorney, Agent, or Firm*—Schwartz & Weinrieb

[57] ABSTRACT

A cabinet for hanging wet fabric, such as a dishcloth, to dry indoors has a completeley open bottom and perforated top and side walls. Access to the inside of the cabinet is attained by a movable door that is preferably unperforated or else has small perforations in locations that hide the hanging cloth from view. The cabinet is streamlined in appearance and promotes efficient air flow because of its horizontally elongated dimensions.

22 Claims, 2 Drawing Sheets

FIG. 1
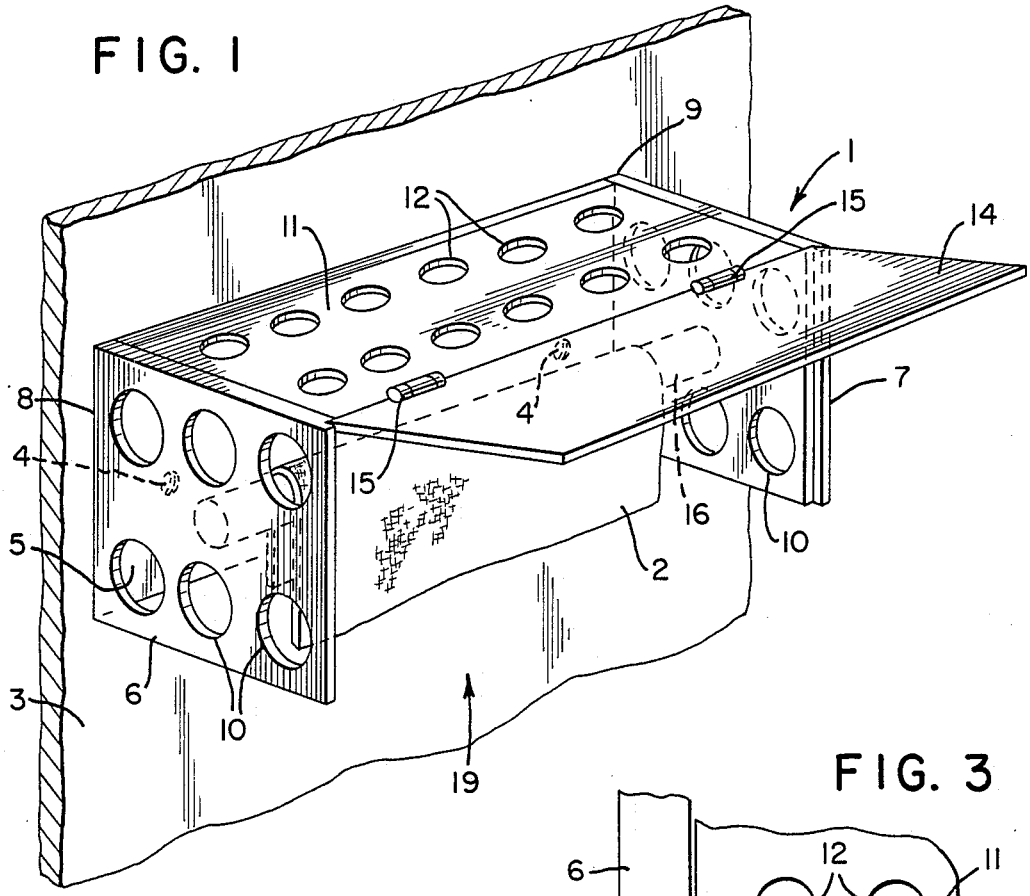
FIG. 3
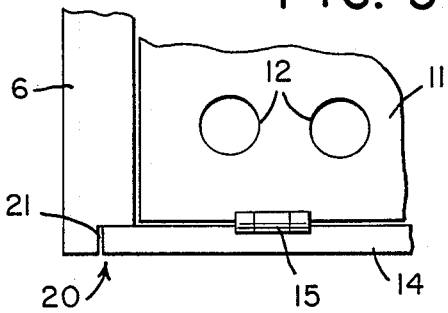
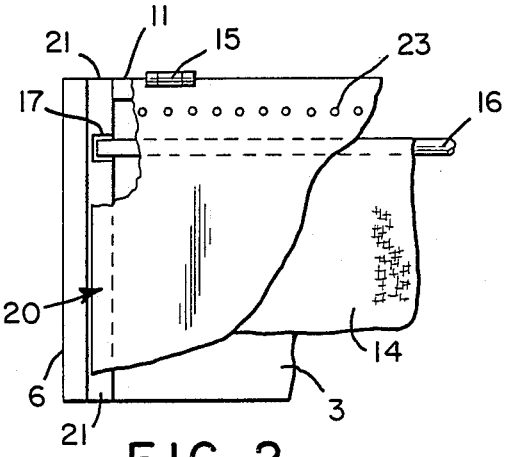
FIG. 2
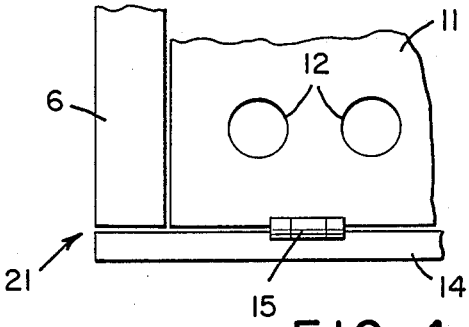
FIG. 4

DISHCLOTH HANGER CABINET

My invention relates generally to the drying of wet fabrics indoors, and more particularly to a wall mounted cabinet in which one or more wet dishcloths may be hung for drying out of sight.

BACKGROUND OF THE INVENTION

Reusable fabric items, such as dishcloths, that become damp when used are usually hung to dry. Such damp fabric items detract from the appearance of the surroundings in which they are hung. Also, the damp fabric may not dry quickly or may develop unpleasant odors if sufficient air does not circulate around it. Prior attempts to provide cabinets for hiding damp cloth items from view while they air dried indoors resulted in relatively large expensive structures that were bulky in appearance and were not easily matched to the decor of their surroundings, especially in a kitchen. Also, many prior drying cabinets required an external power source or some other means to mechanically force air through them.

OBJECTIVES OF THE INVENTION

Accordingly, it is an object of my invention to provide an improved cabinet for drying fabric.

Another object is to provide an indoor drier for damp fabric that works well enough under ambient conditions that it does not require an external power source for forcing air through it.

Another object is to provide a cabinet in which a dishcloth is hung to dry that is streamlined in outline and which does not detract from the appearance of a neat kitchen.

Another object is to provide a dishcloth hanger that has a relatively long horizontal dimension so that dishcloths may be hung out of sight with their longest dimensions horizontal.

Another object is to provide a cabinet for the ambient air drying of damp fabric that efficiently promotes rising air flow with respect to the area the cabinet occupies.

Another object is to provide lightweight, durable, attractive, relatively inexpensive cabinets in which dishcloths may be hung to dry out of sight that are easy to install and to remove, and which do not possess defects found in similar prior art appliances.

Other objects and advantages of my invention will be revealed in the specification, drawing and claims, and the scope of my invention will be set forth in the claims.

DESCRIPTION OF THE DRAWING

FIG. 1 is a perspective view of one embodiment of my invention.

FIG. 2 is a front, partially broken away view showing one way to hang the door in the embodiment of FIG. 1.

FIG. 3 is an enlarged, fragmentary top view of the embodiment of FIG. 2.

FIG. 4 is an enlarged fragmentary top view corresponding to FIG. 3 but showing another way to hand the door.

DESCRIPTION OF THE INVENTION

Figure 5:
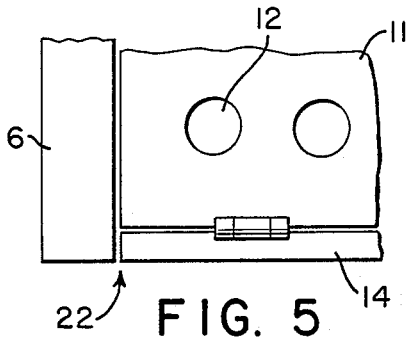
FIG. 5 is an enlarged fragmentary top view corresponding to FIG. 3 but showing still another way to hand the door.

In FIG. 1 the drawing shows a rectangular cabinet 1 for the indoor air drying of damp fabric such as a dishcloth 2. The cabinet 1 should be mounted on a vertical support surface 3, such as a kitchen wall, by any conventional means, such as screws 4 that pass through holes in the back wall 5 of the cabinet. The back wall 5 should not be perforated. A pair of identical side walls 6 and 7 face each other and are attached at their rear ends 8 and 9 to the back wall 5. Side walls 6 and 7 extend perpendicularly away from back wall 5, and have a plurality of evenly spaced openings 10 therethrough. A top 11 is connected to the back wall 5 and side walls 6 and 7. The top 11 has a plurality of evenly spaced holes 12 therethrough. An unperforated front door 14 is pivotally attached to top 11 by hinges 15. Door 14 spans the space between side walls 6 and 7 and closes cabinet 1 from the front when in its lowered position. A cylindrical support rod 16 is attached to side walls 6 and 7 by having its end extend into circular holes 17 in the side walls (see FIG. 2) It is understood that the rod 16 may either terminate within side walls 6 and 7 or pass completely through the outside of said walls 6 and 7. The bottom 19 of cabinet 1 is completely open to promote maximum air flow. The dishcloth 2 should be hung on rod 16 with its longest dimension horizontal.

The horizontal dimension of back wall 5, top 11 and front door 14 (i.e. the space between side walls 6 and 7) should be greater than any of the other dimensions of cabinet 1. Preferably, this horizontal dimension is at least about twice any other cabinet dimension. The cabinent 1 may be made from any suitable moisture resistant material, such as plastic, metal, or coated wood, and hinges 15 should be of the type that will hold the front door 14 in its raised or an intermediate position.

In the remaining FIGS. the same reference numbers used in FIG. 1 have been used to identify corresponding parts. FIGS. 2–5 show the ways in which door 14 may be mounted on cabinet 1. In FIGS. 2 and 3 the side edges of door 14 overlap side walls 6 and 7 at 20. Side walls 6 and 7 each have a vertical groove 21 in their front edge and a side edge of door 14 occupies each groove 21 when door 14 is in its lowered position. In this embodiment the backs of the grooves 21 provide a stop for door 14, and the grooves 21 also hide the edges of door 14 from view. FIG. 2 also shows relatively small perforations 23 in door 14 located vertically above the level of rod 16. Small perforations located above rod 16 will not permit cloth 2 to be seen from the front of cabinet 1. Such perforations 23 may be placed at the top of the front door of any of the other embodiments of my invention. In FIG. 4 the side edges of door 14 also overlap the front edges of side walls 6 and 7 at 21, but in this embodiment there is no groove in the front of the side walls. In FIG. 5 the side edges of front door 14 are enclosed between side walls 6 and 7 at 22 when the front door is positioned to close cabinet 1.

Figure 6:
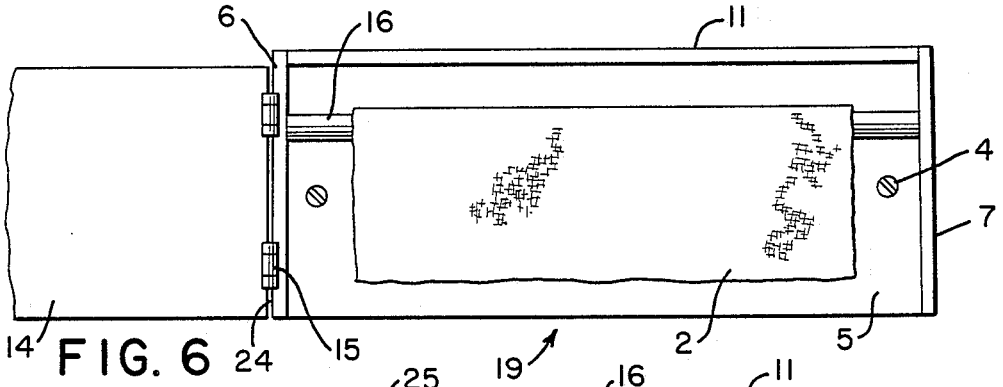
FIG. 6 is a front view showing another embodiment of my invention.

FIG. 6 shows another embodiment of my invention in which front door 14 is hinged at one side 24 to side wall 6. In other respects, this embodiment may be the same as described above.

Figure 7:
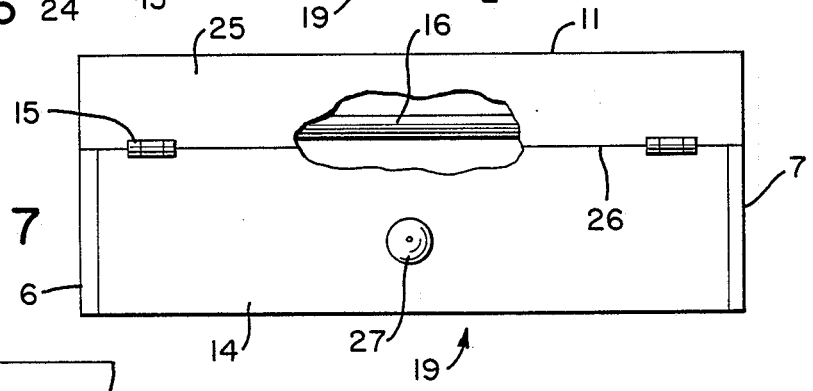
FIG. 7 is a partially broken-away front view showing another embodiment of my invention.

FIG. 7 shows another embodiment of my invention in which a front panel 25 extends downwardly from top 11 until its bottom edge 26 is located at a level slightly below the horizontal plane of support rod 16. Front door 14 is hinged at its top edge to the bottom edge 26 of front panel 25. In other respects this embodiment may be the same as described with reference to FIGS. 1–5. A nob 27 may be provided on front door 14 in any of the embodiments described herein.

Figure 8:
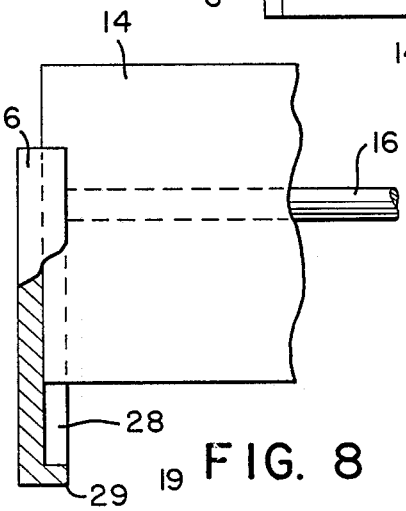
FIG. 8 is an enlarged broken-away, partially cross sectional view showing another embodiment of my invention.
Figure 9:
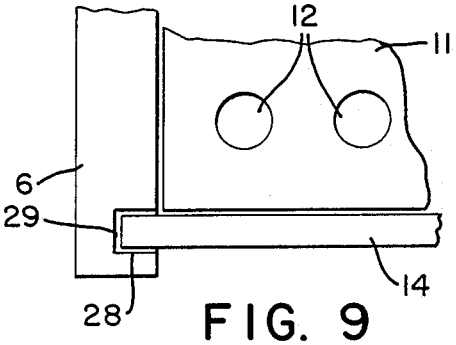
FIG. 9 is an enlarged fragmentary top view of the embodiment of FIG. 8.

FIGS. 8 and 9 show another embodiment in which front door 14 is not pivotally mounted on cabinet 1. Instead, door 14 is slidably connected to cabinet 1 between side walls 6 and 7. The side walls have facing vertical grooves 28 adjacent their inside front edges. The side edges of door 14 are slidably received in grooves 28. The grooves 28 terminate short of the lowermost edge of side walls 6 and 7 and thereby provide stops 29 for holding door 14 in its lowermost position. In other respects this embodiment is the same as those described above.

Figure 10:
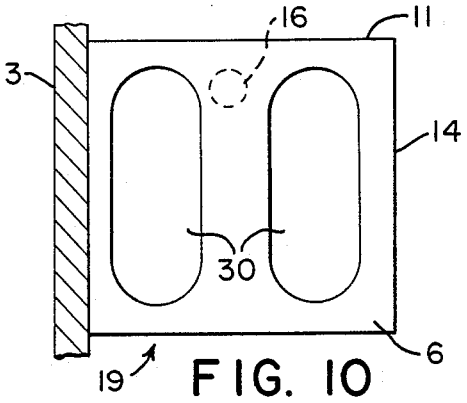
FIG. 10 is a side view of another embodiment of my invention.

FIG. 10 shows another embodiment in which the openings 30 in side walls 6 and 7 are relatively large, symmetrically located and vertically elongated. Support rod 16 is mounted between the elongated openings 30. Preferably openings 30 occupy at least about one half of the surface area of side walls 6 and 7. The large vertically elongated openings 30 promote increased air flow through cabinet 1, yet locating support rod 16 between the openings hides the fabric being dried from view. In other respects this embodiment is the same as those described above.

It has thus been shown that by the practice of my invention, a streamlined, easily installed and moved cabinet 1 may be used to dry one or more dishcloths 2 indoors without requiring the use of an external power source. The use of a back 5, top 11, and front door 14 that are horizontally elongated with respect to the vertical and side dimensions of cabinet 1, and the completely open bottom, promote efficient air flow for the amount of space occupied by the cabinet. This occurs because dishcloth 2 can be hung with its longest dimension horizontal, and therefore the vertical distance that rising air must travel around and through dishcloth 2 is minimized. Also, the long horizontal surface of the cloth exposed to rising air that has not already passed over and picked up moisture from another part of the cloth is maximized. The exact size of the parts of cabinet 1, the size of the holes, openings and perforations in the cabinet, and the materials from which the cabinet is made may vary considerably. This enables individual cabinets 1 to be tailored to the specific decor of the kitchen or other room in which they are used.

While my invention has been described with reference to particular embodiments, I do not intend to illustrate or describe herein all of the equivalent forms or ramifications thereof. For example, door 14 could also be mounted on cabinet 1 so that it can be pulled down or rolled back. Also, the words used are words of description rather than limitation, and various changes may be made without departing from the spirit or scope of my invention disclosed herein. It is intended that the appended claims cover all such changes as fall within the true spirit and scope of my invention.

What I claim as new and desire to secure by Letters Patent of the United States is:

1. A cabinet for air drying damp fabric comprising a back wall and means for attaching said back wall to a vertical support surface; a pair of perforated side walls facing each other and being attached to and extending away from said back wall; a perforated top connecting said back and side walls; a movable front door spanning the space between said side walls; rod means having its ends connected to said side walls and disposed within said cabinet for removably supporting said fabric draped over said rod means such that said fabric is entirely disposed within said cabinet and out of view; and the bottom of said cabinet being open.

2. The invention defined in claim 1, wherein said front door is unperforated.

3. The invention defined in claim 2, wherein said front door is pivotally attached.

4. The invention defined in claim 3, wherein said front door is hinged to said top.

5. The invention defined in claim 4, wherein said front door has side edges that overlap said side walls.

6. The invention defined in claim 5, wherein each of said side walls has a vertical groove in its front edge and each side edge of said front door occupies one of said vertical grooves when said front door is positioned to close said cabinet.

7. The invention defined in claim 2, wherein the openings that perforate said side walls are vertically elongated.

8. The invention defined in claim 7, wherein said vertically elongated openings occupy at least about one half of the surface area of said side walls.

9. The invention defined in claim 8, wherein said support rod is mounted between said vertically elongated openings.

10. The invention defined in claim 2, wherein said front door is slidably connected to said cabinet.

11. The invention defined in claim 10, wherein said front door is slidably mounted between said side walls.

12. The invention defined in claim 11, wherein said side walls have facing vertical grooves and an edge of said front door is slidably received in each of said grooves.

13. The invention defined in claim 12, wherein said vertical grooves terminate short of the lowermost edge of said side walls and thereby provide stops for holding said door in its lowermost position.

14. The invention defined in claim 3, wherein said front door is hinged to one of said side walls.

15. The invention defined in claim 3, further comprising a front panel attached to said top and spanning said side walls, and said front door is hinged at the bottom edge of said front panel.

16. The invention defined in claim 12, wherein said front panel extends downwardly from said top to a level where its bottom edge is slightly below the horizontal plane of said support rod.

17. The invention defined in claim 4, wherein said front door has side edges that are enclosed between said side walls when said front door is positioned to close said cabinet.

18. The invention defined in claim 1, further comprising perforations is said front door located vertically above said support rod.

19. A rectangular cabinet for the indoor air drying of a dishcloth that has a predetermined longest dimension, said cabinet comprising a back wall and means for attaching said back wall to a vertical support surface; a pair of identical perforated side walls facing each other and being attached at their rear ends to said back wall, said side walls extending generally perpendicularly from said back wall; a perforated top connecting said back and side walls; an upperforated front door hinged to said top and spanning the space between said side walls; a cylindrical support rod having its ends connected to said side walls within said cabinet; the bottom of said cabinet being open; and the horizontal dimension of said back, said top and said front door being substantially greater than any other dimension of the parts of said cabinet; whereby said dishcloth may be hung on said support rod with its longest dimension horizontal yet still be concealed from view.

20. The invention defined in claim 19, wherein said horizontal dimension of said back, top and door is at least twice as great as any other dimension of said parts of said cabinet.

21. The invention of claim 22 wherein said support surface is vertical, said sidewalls and top are perforated, and said front door is movable.

22. A cabinet for air drying damp fabric comprising a back wall and means for attaching said back wall to a support surface; a pair of side walls facing each other and being attached to and extending away from said back wall; a top connecting said back and side walls; a front door spanning the space between said side walls; rod means having its ends connected to said side walls and disposed within said cabinet for removably supporting said fabric draped over said rod means such that said fabric is entirely disposed within said cabinet and out of view; and the bottom of said cabinet being open.

* * * * *